US012618351B2

(12) United States Patent
Verseman et al.

(10) Patent No.: US 12,618,351 B2
(45) Date of Patent: May 5, 2026

(54) SYSTEMS AND METHODS FOR MIXING EXHAUST GAS

(71) Applicant: Cummins Emission Solutions Inc., Columbus, IN (US)

(72) Inventors: Corey Verseman, Fitchburg, WI (US); Jacob D. Canik, Stoughton, WI (US); Jose De Jesus Alvarez Duenas, Fitchburg, WI (US); Dustin Youngs, Fitchburg, WI (US); Rodrigo Macano Rodrigues, Greenwood, IN (US); Jeffrey T. Sedlacek, Stoughton, WI (US); Alex Kushner, McFarland, WI (US)

(73) Assignee: Cummins Emission Solutions Inc., Columbus, IN (US)

( * ) Notice: Subject to any disclaimer, the term of this patent is extended or adjusted under 35 U.S.C. 154(b) by 0 days.

(21) Appl. No.: 18/785,436

(22) Filed: Jul. 26, 2024

(65) Prior Publication Data

US 2026/0028929 A1 Jan. 29, 2026

(51) Int. Cl.
*F01N 3/28* (2006.01)
*F01N 3/035* (2006.01)

(52) U.S. Cl.
CPC ..... *F01N 3/2892* (2013.01); *F01N 3/035* (2013.01); *F01N 2240/20* (2013.01)

(58) Field of Classification Search
CPC .... F01N 3/2892; F01N 3/035; F01N 2240/20; F01N 3/18
See application file for complete search history.

(56) References Cited

U.S. PATENT DOCUMENTS

| | | | | |
|---|---|---|---|---|
| 8,359,832 | B2 | 1/2013 | Yi et al. | |
| 9,790,833 | B2 * | 10/2017 | Kobe | B01F 23/2132 |
| 11,686,234 | B2 | 6/2023 | Zurn et al. | |
| 2006/0162690 | A1 * | 7/2006 | Kim | F02B 31/04 123/306 |
| 2007/0245718 | A1 * | 10/2007 | Cheng | F01N 3/2066 60/286 |
| 2009/0266064 | A1 * | 10/2009 | Zheng | B01F 25/4315 60/317 |
| 2011/0167810 | A1 * | 7/2011 | Lebas | B01F 25/4521 60/324 |
| 2013/0091830 | A1 * | 4/2013 | Li | B01F 25/4316 261/87 |

(Continued)

FOREIGN PATENT DOCUMENTS

| | | |
|---|---|---|
| CN | 211314339 U | 8/2020 |
| CN | 212272368 U | 1/2021 |

(Continued)

*Primary Examiner* — Matthew T Largi
(74) *Attorney, Agent, or Firm* — Foley & Lardner LLP

(57) ABSTRACT

A mixer for an exhaust gas aftertreatment system includes an outer circumferential edge that extends in a first plane perpendicular to a longitudinal axis of the mixer, a hub including a flat portion that extends in a second plane perpendicular to the longitudinal axis, the second plane being offset from the first plane in a direction along the longitudinal axis; a plurality of openings, each extending in a region between the hub and the outer circumferential edge of the mixer; and a plurality of fins, each extending from at least one edge of the plurality of openings.

23 Claims, 12 Drawing Sheets

(56) References Cited

U.S. PATENT DOCUMENTS

| | | | | |
|---|---|---|---|---|
| 2015/0308316 | A1* | 10/2015 | Li | F01N 3/2892 60/295 |
| 2016/0312679 | A1* | 10/2016 | Schellin | F01N 3/2066 |
| 2017/0022869 | A1* | 1/2017 | Ly | B01F 25/25 |
| 2018/0306083 | A1* | 10/2018 | Sampath | B01F 25/3141 |
| 2019/0063377 | A1* | 2/2019 | Dudar | F02D 41/029 |
| 2022/0316382 | A1* | 10/2022 | De Rudder | B01D 53/9418 |

FOREIGN PATENT DOCUMENTS

| | | |
|---|---|---|
| GB | 2 595 019 A | 11/2021 |
| GB | 2 602 770 A | 7/2022 |

* cited by examiner

SYSTEMS AND METHODS FOR MIXING EXHAUST GAS

TECHNICAL FIELD

The present disclosure relates generally to aftertreatment systems for internal combustion (IC) engines. More specifically, the present disclosure relates to mixing exhaust gas in exhaust gas aftertreatment systems.

BACKGROUND

The exhaust of internal combustion engines, such as diesel engines, includes nitrogen oxide ($NO_x$) compounds. To reduce $NO_x$ emissions, a treatment fluid may be dosed into the exhaust by a doser assembly within an aftertreatment system. The treatment fluid facilitates conversion of a portion of the exhaust into non-$NO_x$ emissions, such as nitrogen ($N_2$), carbon dioxide ($CO_2$), and water ($H_2O$), thereby reducing $NO_x$ emissions.

SUMMARY

At least one aspect of the present disclosure is directed to a mixer for an exhaust gas aftertreatment system. The mixer includes an outer circumferential edge that extends in a first plane perpendicular to a longitudinal axis of the mixer. The mixer includes a hub. The hub includes a flat portion that extends in a second plane perpendicular to the longitudinal axis. The second plane is offset from the first plane in a direction along the longitudinal axis. The mixer includes a plurality of openings, each extending in a region between the hub and the outer circumferential edge of the mixer. The mixer includes a plurality of fins, each extending from at least one edge of the plurality of openings.

In some embodiments, the mixer includes a plurality of tabs disposed along the outer circumferential edge of the mixer. Each of the plurality of tabs can extend in a respective third plane. A leading edge of the each of the plurality of tabs can be oriented towards the hub and away from the longitudinal axis of the mixer. The longitudinal axis can be oblique to the respective third plane. In some embodiments, each of the plurality of fins is convex relative to the hub. In some embodiments, each of the plurality of fins extends from the hub. In some embodiments, the mixer has an inner circumferential edge. Each of the plurality of fins can extend from the inner circumferential edge.

In some embodiments, the outer circumferential edge, the flat portion, and the plurality of openings define a frustoconical profile. In some embodiments, the mixer includes a notch disposed on the outer circumferential edge of the mixer. The notch can be configured to allow a liquid to flow from a first side of the mixer to a second side of the mixer.

In some embodiments, each fin includes a first portion that is convex relative to the hub. The first portion can be coupled with the at least one edge of the plurality of openings. Each fin can include a second portion that is concave relative to the hub. The second portion can be coupled with the first portion. In some embodiments, the mixer includes a plurality of spokes, each extending from the hub to the outer circumferential edge of the mixer and each positioned between two openings of the plurality of openings.

In some embodiments, an aftertreatment system includes an exhaust conduit, a filter disposed in the exhaust conduit, and a mixer disposed in the exhaust conduit at a location downstream of the filter. The mixer can include an outer circumferential edge that extends in a first plane perpendicular to a longitudinal axis of the mixer. The mixer can include a hub. The hub can include a flat portion that extends in a second plane perpendicular to the longitudinal axis. The second plane can be offset from the first plane in a direction along the longitudinal axis. The mixer can include a plurality of openings, each extending in a region between the hub and the outer circumferential edge of the mixer. The mixer can include a plurality of fins, each extending from at least one edge of the plurality of openings. The aftertreatment system can include a sensor disposed in the exhaust conduit at a location downstream of the mixer.

In some embodiments, the mixer includes a notch disposed on the outer circumferential edge of the mixer. The notch can be configured to engage with an alignment element disposed in the exhaust conduit. In some embodiments, exhaust gas is configured to contact the mixer downstream of the outer circumferential edge of the mixer. In some embodiments, exhaust gas is configured to contact the mixer upstream of the outer circumferential edge of the mixer. In some embodiments, the mixer includes a plurality of tabs disposed along the outer circumferential edge of the mixer. The plurality of tabs can be welded to the exhaust conduit.

In some embodiments, the mixer includes a plurality of tabs disposed along the outer circumferential edge of the mixer. Each tab of the plurality of tabs can include a leading edge. Prior to the mixer being positioned in the exhaust conduit, the plurality of leading edges can be arranged around a first circle having a first diameter greater than an exhaust conduit diameter. After the mixer is positioned in the exhaust conduit, the plurality of leading edges can be arranged around a second circle having a second diameter equal to the exhaust conduit diameter In some embodiments, a diesel particulate filter catalyst is disposed in the exhaust conduit at a location downstream of the filter and upstream of the mixer. The hub can be positioned a distance from the diesel particulate filter catalyst. In some embodiments, the mixer includes a plurality of tabs disposed along the outer circumferential edge of the mixer. The plurality of tabs can elastically deform upon insertion into the exhaust conduit. In some embodiments, the outer circumferential edge of the mixer has a diameter equal to an exhaust conduit diameter.

Another aspect of the present disclosure is directed to an aftertreatment system. The aftertreatment system includes an exhaust conduit. The aftertreatment system includes a filter disposed in the exhaust conduit. The aftertreatment system includes a mixer disposed in the exhaust conduit at a location downstream of the filter. The aftertreatment system includes a sensor disposed in the exhaust conduit at a location downstream of the mixer. The mixer includes a plurality of tabs disposed along an outer circumferential edge of the mixer. Each tab of the plurality of tabs includes a leading edge. Prior to the mixer being positioned in the exhaust conduit, the plurality of leading edges can be arranged around a first circle having a first diameter greater than an exhaust conduit diameter. After the mixer is positioned in the exhaust conduit, the plurality of leading edges can be arranged around a second circle having a second diameter equal to the exhaust conduit diameter.

In some embodiments, the outer circumferential edge extends in a first plane perpendicular to a longitudinal axis of the mixer. In some embodiments, the mixer includes a hub that extends in a second plane perpendicular to the longitudinal axis of the mixer. Each of the plurality of tabs can extend in a respective third plane. The leading edge of the each of the plurality of tabs can be oriented towards the hub and away from the longitudinal axis of the mixer. The longitudinal axis can be oblique to the respective third plane.

In some embodiments, the second plane is offset from the first plane in a direction along the longitudinal axis. In some embodiments, the plurality of tabs are configured to be welded to the exhaust conduit. In some embodiments, the plurality of tabs are configured to elastically deform upon insertion into the exhaust conduit. In some embodiments, the mixer includes a notch disposed on the outer circumferential edge of the mixer. The notch can allow a liquid to flow from a first side of the mixer to a second side of the mixer. In some embodiments, the notch is configured to engage with an alignment element disposed in the exhaust conduit.

Another aspect of the present disclosure is directed to a mixer for an exhaust gas aftertreatment system. The mixer includes an outer circumferential edge that extends in a first plane perpendicular to a longitudinal axis of the mixer. The mixer includes a hub. The hub includes a flat portion that extends in a second plane perpendicular to the longitudinal axis of the mixer. The mixer includes a plurality of openings, each extending in a region between the hub and the outer circumferential edge of the mixer. The mixer includes a plurality of fins, each extending from at least one edge of the plurality of openings. Each of the plurality of fins includes a first portion that is convex relative to the hub. The first portion can be coupled with the at least one edge of the plurality of openings. Each of the plurality of fins includes a second portion that is concave relative to the hub. The second portion can be coupled with the first portion.

In some embodiments, each fin includes a third portion that is flat. The third portion can be coupled with the second portion. In some embodiments, each of the plurality of fins extends from the hub. In some embodiments, the mixer has an inner circumferential edge, and each of the plurality of fins extends from the inner circumferential edge.

In some embodiments, the mixer includes a plurality of tabs disposed along the outer circumferential edge of the mixer. Each of the plurality of tabs can extend in a respective third plane. A leading edge of the each of the plurality of tabs can be oriented towards the hub and away from the longitudinal axis of the mixer. In some embodiments, the longitudinal axis can be oblique to the respective third plane.

In some embodiments, the outer circumferential edge, the flat portion, and the plurality of openings define a frustoconical profile. In some embodiments, the mixer includes a notch disposed on the outer circumferential edge of the mixer. The notch can allow a liquid to flow from a first side of the mixer to a second side of the mixer. In some embodiments, the second plane is offset from the first plane in a direction along the longitudinal axis.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

A clear conception of the advantages and features constituting the present disclosure, and of the construction and operation of typical mechanisms provided with the present disclosure, will become more readily apparent by referring to the exemplary, and therefore non-limiting, embodiments illustrated in the drawings accompanying and forming a part of this specification, wherein like reference numerals designate the same elements in the several views, and in which.

The foregoing and other features of the present disclosure will become apparent from the following description and appended claims, taken in conjunction with the accompanying drawings. Understanding that these drawings depict only several embodiments in accordance with the disclosure and are therefore, not to be considered limiting of its scope, the disclosure will be described with additional specificity and detail through use of the accompanying drawings.

DETAILED DESCRIPTION

Following below are more detailed descriptions of various concepts related to, and implementations of, methods, apparatuses, and systems for mixing exhaust gas. The various concepts introduced above and discussed in greater detail below may be implemented in any of a number of ways, as the described concepts are not limited to any particular manner of implementation. Examples of specific implementations and applications are provided primarily for illustrative purposes.

I. Overview

Internal combustion engines (e.g., diesel internal combustion engines, etc.) produce exhaust (e.g., exhaust gas) that may be treated by an aftertreatment system. A sensor located downstream of a particulate filter in the aftertreatment system can detect particulate matter that gets past or is not captured by the particulate filter. However, localized failures in the particulate filter can result in the sensor failing to detect the particulate matter or providing an inaccurate measurement of the concentration of the particulate matter in the exhaust gas. This can be due to the particulate matter being unevenly distributed in the exhaust gas such that the particulate matter is not detected by the sensor. For example, a failure of the particulate filter that is aligned with the sensor may be detected. In contrast, a failure of the particulate filter that is not aligned with the sensor may not be detected.

The systems and methods of the present disclosure relate to a device configured to mix the exhaust gas after the exhaust gas leaves the particulate filter and before the exhaust gas reaches the sensor. The device is configured to distribute particulate matter within the exhaust gas downstream of the mixer. By distributing the particulate matter within the exhaust gas using the device, detection of localized failures in the particulate filter can be enhanced.

II. Overview of Exhaust Gas Aftertreatment Systems

Figure 1:
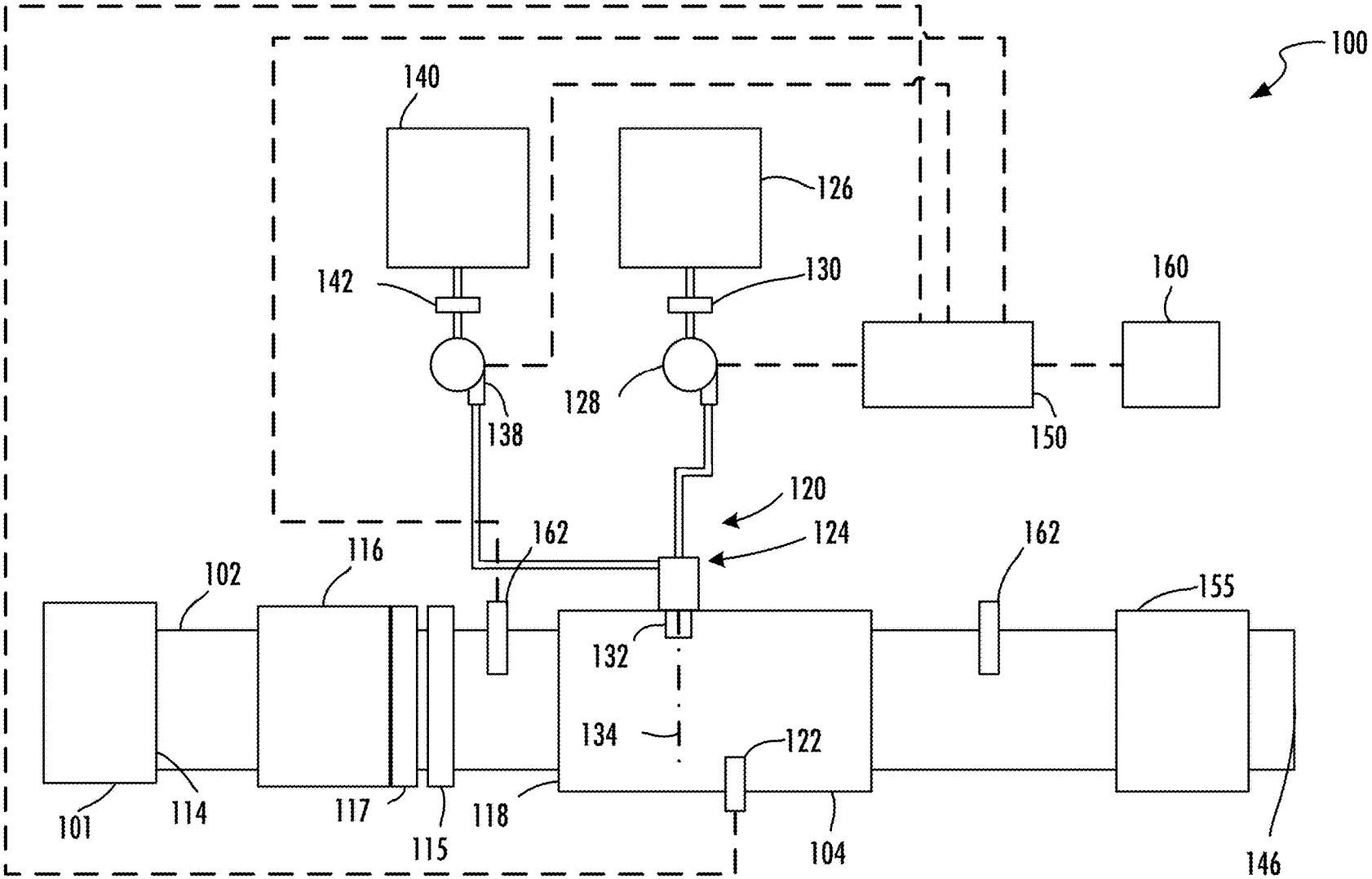
FIG. 1 illustrates a schematic diagram of an aftertreatment system with a mixer, according to an example implementation.

FIG. 1 depicts an aftertreatment system 100 (e.g., exhaust aftertreatment system, exhaust gas aftertreatment system). The aftertreatment system 100 is configured to receive exhaust gas (e.g., diesel exhaust gas, etc.) from an engine 101 (e.g., internal combustion engine, etc.) and treat constituents (e.g., $NO_x$, CO, $CO_2$, etc.) of the exhaust gas. The engine 101 is configured to (e.g., structured to, able to, etc.) receive a fluid mixture of fuel (e.g., diesel, gasoline, hydrogen, etc.) and air, combust the fluid mixture, and provide an exhaust based on combustion of the fluid mixture. The engine 101 may include, for example, a diesel engine, a gasoline engine, a natural gas engine, a dual fuel engine, a biodiesel engine, an E-85 engine, or any other suitable engine. The engine 101 combusts fuel and generates an exhaust gas that includes $NO_x$, CO, $CO_2$, and other constituents. The engine 101 may include other components, for example, a transmission, fuel insertion assemblies, or a generator or alternator to convert the mechanical power produced by the engine 101 into electrical power.

The aftertreatment system 100 includes a housing 104 (e.g., casing, cover, container, shell, etc.) in which various aftertreatment components of the aftertreatment system 100 are disposed. The housing 104 may be formed from a rigid, heat-resistant and corrosion-resistant material, for example stainless steel, iron, aluminum, metals, ceramics, or any other suitable material. The housing 104 may have any suitable cross-section, for example, circular, square, rectangular, oval, elliptical, polygonal, or any other suitable shape.

The aftertreatment system 100 includes an exhaust conduit 102 (e.g., channel, duct, pipe, tube, chute, conduit, etc.) that is fluidly coupled to the engine 101. The exhaust conduit 102 is structured to receive exhaust gas from the engine 101 via an inlet 114. The exhaust conduit 102 is structured to release treated exhaust via outlet 146. Treated exhaust can include exhaust that has been treated to removed particulate matter and/or reduced constituents of the exhaust gas such as $NO_x$ gases, CO, unburnt hydrocarbons, etc.

The aftertreatment system 100 includes a particulate filter 116 (e.g., a diesel particulate filter (DPF), filter, etc.). The particulate filter 116 is disposed in the exhaust conduit 102. The particulate filter 116 is coupled to the exhaust conduit 102 and is configured to remove particulate matter, such as soot, from the exhaust flowing in the exhaust conduit 102. The particulate filter 116 includes an inlet, where the exhaust is received, and an outlet, where the exhaust exits after having particulate matter substantially filtered from the exhaust and/or converting the particulate matter into $CO_2$. In some embodiments, the particulate filter 116 may include a ceramic filter. In some embodiments, the particulate filter 116 may include a cordierite filter which can, for example, be an asymmetric filter.

The aftertreatment system 100 includes a diesel particulate filter (DPF) catalyst 117. The DPF catalyst 117 is coupled to the exhaust conduit 102. For example, the DPF catalyst 117 can be disposed in the exhaust conduit 102. The DPF catalyst 117 is disposed downstream of the particulate filter 116. The DPF catalyst 117 has a first side and a second side. The first side of the DPF catalyst 117 can be upstream of the second side of the DPF catalyst 117. The first side of the DPF catalyst 117 can be coupled with the particulate filter 116.

The aftertreatment system 100 includes a mixer 115 (e.g., a mixing body assembly, mixer plate, exhaust constituent uniformity device, a swirl generating device, a vane plate, an inlet plate, a deflector plate). The mixer 115 is coupled to the exhaust conduit 102. The mixer 115 is disposed in the exhaust conduit 102 at a location downstream of the DPF catalyst 117. The DPF catalyst 117 can be disposed upstream of the mixer 115. The mixer 115 can be adjacent to the DPF catalyst 117. The mixer 115 and the DPF catalyst 117 can be separated by a distance. For example, a distance can separate the mixer 115 and the second side of the DPF catalyst 117. The mixer 115 is disposed in the exhaust conduit 102 at a location downstream of the particulate filter 116. The mixer 115 is configured to receive exhaust from the particulate filter 116.

The mixer 115 is configured to facilitate swirling (e.g., tumbling, rotation, etc.) of the exhaust and mixing (e.g., combination, etc.) of the exhaust so as to distribute particulate matter within the exhaust downstream of the mixer 115. By distributing particulate matter within the exhaust (e.g., to obtain an increased uniformity index, etc.) using the mixer 115, detection of localized failures in the particulate filter 116 can be enhanced. A localized failure of the particulate filter 116 can include an area or region of the particulate filter 116 that has become damaged or that allows particulate matter to get through the particulate filter 116. The mixer 115 can increase the uniformity of the exhaust gas. For example, the mixer 115 can distribute the particulate matter evenly throughout the exhaust gas. The mixer 115 can partially block and redirect exhaust flow through the exhaust conduit 102. The mixer 115 can distribute (e.g., uniformly distribute, more evenly distribute) the particulate matter in the exhaust gas downstream of the particulate filter 116.

The aftertreatment system 100 includes a decomposition chamber 118 (e.g., reactor, reactor pipe, conduit, housing, etc.) disposed downstream of the mixer 115. The decomposition chamber 118 is configured to receive the exhaust from the particulate filter 116. For example, the decomposition chamber 118 is configured to receive exhaust that has passed through the mixer 115. The aftertreatment system 100 further includes a treatment fluid delivery system 120 coupled to the decomposition chamber 118. The treatment fluid delivery system 120 is configured to deliver treatment fluid to the decomposition chamber 118. The treatment fluid may be, for example, a reductant (e.g., a urea, a diesel exhaust fluid (DEF), Adblue®, a urea water solution (UWS), an aqueous urea solution (e.g., AUS32, etc.), and/or other similar fluids) or a hydrocarbon fluid (e.g., a fuel, an oil, an additive, etc.). When the reductant is introduced into the exhaust, reduction of emission of undesirable components (e.g., $NO_x$, etc.) in the exhaust may be facilitated. When the hydrocarbon fluid is introduced into the exhaust, the temperature of the exhaust may be increased (e.g., to facilitate regeneration of components of the aftertreatment system 100, etc.). For example, the aftertreatment system 100 may include an igniter 122 (e.g., spark plug, etc.) configured to increase the temperature of the exhaust by combusting the hydrocarbon fluid within the exhaust. The decomposition chamber 118 includes an inlet in fluid communication with the particulate filter 116 to receive the exhaust containing $NO_x$ emissions and an outlet for the exhaust, $NO_x$ emissions, ammonia, and/or the treatment fluid to flow to downstream components of the aftertreatment system 100.

The treatment fluid delivery system 120 includes a doser assembly 124 (e.g., a dosing module, etc.) configured to dose the treatment fluid into the decomposition chamber 118 (e.g., via an injector). The doser assembly 124 is mounted to the decomposition chamber 118 such that the doser assembly 124 may dose the treatment fluid into the exhaust flowing through the exhaust conduit 102.

The doser assembly 124 is fluidly coupled to (e.g., fluidly configured to communicate with, etc.) a treatment fluid source 126. The treatment fluid source 126 may include multiple treatment fluid sources 126. The treatment fluid source 126 may be, for example, a diesel exhaust fluid tank containing Adblue®. A treatment fluid pump 128 (e.g., a supply unit, etc.) is used to pressurize the treatment fluid from the treatment fluid source 126 for delivery to the doser assembly 124. In some embodiments, the treatment fluid pump 128 is pressure-controlled (e.g., controlled to obtain a target pressure, etc.). The treatment fluid pump 128 may include a treatment fluid filter 130. The treatment fluid filter 130 filters (e.g., strains, etc.) the treatment fluid prior to the treatment fluid being provided to internal components (e.g., pistons, vanes, etc.) of the treatment fluid pump 128. For example, the treatment fluid filter 130 may inhibit or prevent the transmission of solids (e.g., solidified treatment fluid, contaminants, etc.) to the internal components of the treatment fluid pump 128. In this way, the treatment fluid filter 130 may facilitate prolonged desirable operation of the treatment fluid pump 128.

The doser assembly 124 includes at least one injector 132 (e.g., reductant injector). Each injector 132 is configured to dose the treatment fluid into the exhaust (e.g., within the decomposition chamber 118, etc.). The injector 132 is configured to insert reductant (e.g., a combined flow of reductant and compressed air) into the decomposition chamber 118.

The treatment fluid delivery system 120 may include an air pump 138. The air pump 138 draws air from an air source 140 (e.g., an air intake, etc.) through an air filter 142 disposed upstream of the air pump 138 and provides the air to the doser assembly 124 via a conduit. In these embodiments, the doser assembly 124 is configured to mix the air and the treatment fluid into an air-treatment fluid mixture and to provide the air-treatment fluid mixture into the decomposition chamber 118. In other embodiments, the treatment fluid delivery system 120 does not include the air pump 138, the air source 140, and/or the air filter 142. In such embodiments, the doser assembly 124 is not configured to mix the treatment fluid with the air.

The aftertreatment system 100 includes a catalyst system 155. The catalyst system 155 is configured to decompose constituents of the exhaust gas flowing through the exhaust conduit 102. In some embodiments, the catalyst system 155 includes a catalyst member (e.g., a selective catalytic reduction (SCR) catalyst member, SCR catalyst, etc.) disposed downstream of the decomposition chamber 118. As a result, the treatment fluid is injected upstream of the catalyst member such that the catalyst member receives a mixture of the treatment fluid and exhaust. Droplets of the treatment fluid undergo processes of evaporation, thermolysis, and hydrolysis to form non-$NO_x$ emissions (e.g., gaseous ammonia, etc.) within the exhaust conduit 102. The SCR catalyst is configured to catalyze decomposition of $NO_x$ gases into its constituents in the presence of a reductant. Any suitable SCR catalyst may be used such as, for example, platinum, palladium, rhodium, cerium, iron, manganese, copper, vanadium-based catalyst, any other suitable catalyst, or a combination thereof. The SCR catalyst may be disposed on a suitable substrate such as, for example, a ceramic (e.g., cordierite) or metallic (e.g., kanthal) monolith core that can, for example, define a honeycomb structure. In other embodiments, the catalyst system 155 includes an oxidation catalyst member (e.g., a diesel oxidation catalyst (DOC), an ammonia oxidation catalyst ($AMO_x$), etc.). The oxidation catalyst member can oxidize hydrocarbons and carbon monoxide in the exhaust. In yet other embodiments, the catalyst system 155 includes a particulate filter (e.g., the particulate filter 116, etc.).

The catalyst system 155 includes an upstream face in fluid communication with the decomposition chamber 118 from which the exhaust and the treatment fluid are received and a downstream face in fluid communication with the outlet 146 of the exhaust conduit 102. The outlet 146 may release the treated exhaust into an ambient environment or another treatment system. In some embodiments, the particulate filter 116 may be positioned downstream of the decomposition chamber 118. For instance, the particulate filter 116 and the catalyst system 155 may be combined into a single unit.

The aftertreatment system 100 includes a controller 150 (a treatment fluid delivery system controller, etc.). The controller 150 is electrically or communicatively coupled to the igniter 122. The controller 150 may control the igniter 122 to ignite the treatment fluid in the decomposition chamber 118. For example, where the controller 150 may cause the igniter 122 to provide an electrical arc in a region traversed by the hydrocarbon fluid, and the electrical arc may ignite the hydrocarbon fluid. The controller 150 is electrically or communicatively coupled to the doser assembly 124. The controller 150 may control the doser assembly 124 to dose the treatment fluid into the decomposition chamber 118. The controller 150 is electrically or communicatively coupled to the treatment fluid pump 128 and/or the air pump 138. The controller 150 may also control operations of the treatment fluid pump 128 and/or the air pump 138. The controller 150 is electrically or communicatively coupled to the engine 101. The controller 150 may also control operations of the engine 101 (e.g., spark plug ignition, fuel injection, etc.).

The controller 150 includes a processing circuit. The processing circuit includes a processor and a memory. The processor may include a microprocessor, an application-specific integrated circuit (ASIC), a field-programmable gate array (FPGA), etc., or combinations thereof. The memory may include, but is not limited to, electronic, optical, magnetic, or any other storage or transmission device capable of providing the processor with program instructions. This memory may include a memory chip, Electrically Erasable Programmable Read-Only Memory (EEPROM), Erasable Programmable Read Only Memory (EPROM), flash memory, or any other suitable memory from which the controller 150 can read instructions. The instructions may include code from any suitable programming language. The memory may include various modules that include instructions which are configured to be implemented by the processor.

The controller 150 may be configured to communicate with a central controller 160 (e.g., engine control unit (ECU), engine control module (ECM), etc.) of the engine 101. In some embodiments, the central controller 160 and the controller 150 are integrated into a single controller. In some embodiments, the central controller 160 is communicable with a display device (e.g., a screen, a monitor, a touch screen, a heads up display (HUD), an indicator light, etc.). The display device may be configured to change state in response to receiving information from the central controller 160. For example, the display device may be configured to change between a static state (e.g., displaying a green light, displaying a "SYSTEM OK" message, etc.) and an alarm state (e.g., displaying a blinking red light, displaying a "SERVICE NEEDED" message, etc.) based on a communication from the central controller 160. By changing state, the display device may provide an indication to a user (e.g., an operator, a technician, etc.) of a status (e.g., operation, in need of service, etc.) of the treatment fluid delivery system 120 and/or the aftertreatment system 100.

The aftertreatment system 100 includes one or more sensors 162. The sensor 162 may be disposed within the aftertreatment system 100. The sensor 162 may be disposed in the exhaust conduit 102 at a location downstream of the mixer 115. The sensor 162 may be disposed upstream, within, around, or downstream of the catalyst system 155. The sensor 162 may be disposed upstream, within, around, or downstream of the particulate filter 116. The sensor 162 is electrically or communicatively coupled to the controller 150 and is configured to provide one or more signals associated with the exhaust and/or the fluid mixture of the exhaust and the treatment fluid to the controller 150. The sensor 162 is configured to provide a signal and the controller 150 is configured to receive the signal from the sensor 162 and determine a characteristic of the exhaust and/or the fluid mixture of the exhaust and the treatment fluid based on the signal. Each of the sensors 162 may facilitate measurement of the same characteristic or a number of characteristics of the exhaust and/or treatment fluid.

In some embodiments, the sensor 162, or at least one of the sensors 162, may be a particulate matter (PM) sensor (e.g., PM sensor probe) and the signal may be a particulate matter signal, such that the controller 150 determines a concentration of the particulate matter of the exhaust and/or the fluid mixture of the exhaust and the treatment fluid based on the particulate matter signal. The PM sensor can be configured to detect particulate matter that gets past the particulate filter 116. The PM sensor can be disposed at a location downstream of the mixer 115 and upstream of the decomposition chamber 118. Without the mixer 115, localized failures of the particulate filter 116 may escape detection of the PM sensor. For example, without the mixer 115, localized failures of the particulate filter 116 may allow particulate matter to get past the particulate filter 116. If the exhaust gas is not mixed downstream of the particulate filter 116, the PM sensor may not be able to detect the particulate matter, or the PM sensor may give an inaccurate measurement of the concentration of particulate matter in the exhaust gas. The mixer 115 can allow the PM sensor to detect a DPF failure within a short distance. The PM sensor can detect a DPF failure. In some embodiments, there is a singular mixing element (e.g., mixing device, mixer 115) between the PM sensor and the particulate filter 116.

The sensor 162, or at least one of the sensors 162, is a temperature sensor and the signal is a temperature signal, such that the controller 150 determines the temperature of the exhaust and/or the fluid mixture of the exhaust and the treatment fluid based on the temperature signal. The temperature of the exhaust and/or the fluid mixture of the exhaust and the treatment fluid determined by the controller 150 based on the temperature signal may represent an estimated temperature of the of the catalyst system 155. In other embodiments, the sensor 162 is a non-temperature sensor and the signal is a non-temperature signal associated with the temperature of the exhaust and/or the fluid mixture of the exhaust and the treatment fluid, such that the controller 150 determines the temperature of the exhaust and/or the fluid mixture based on the non-temperature signal. For example, the sensor 162 may be a pressure sensor and/or a velocity sensor and the signal may be a pressure signal and/or a velocity signal, and the controller 150 is configured to determine the temperature of the exhaust and/or the fluid mixture of the exhaust and the treatment fluid based on the pressure signal and/or the velocity signal.

The sensor 162, or at least one of the sensors 162, may be a nitrogen oxide sensor and the signal may be a nitrogen oxide signal, such that the controller 150 determines a concentration of the nitrogen oxide of the exhaust and/or the fluid mixture of the exhaust and the treatment fluid based on the nitrogen oxide signal.

III. Overview of Example Mixing Devices

Figure 2:
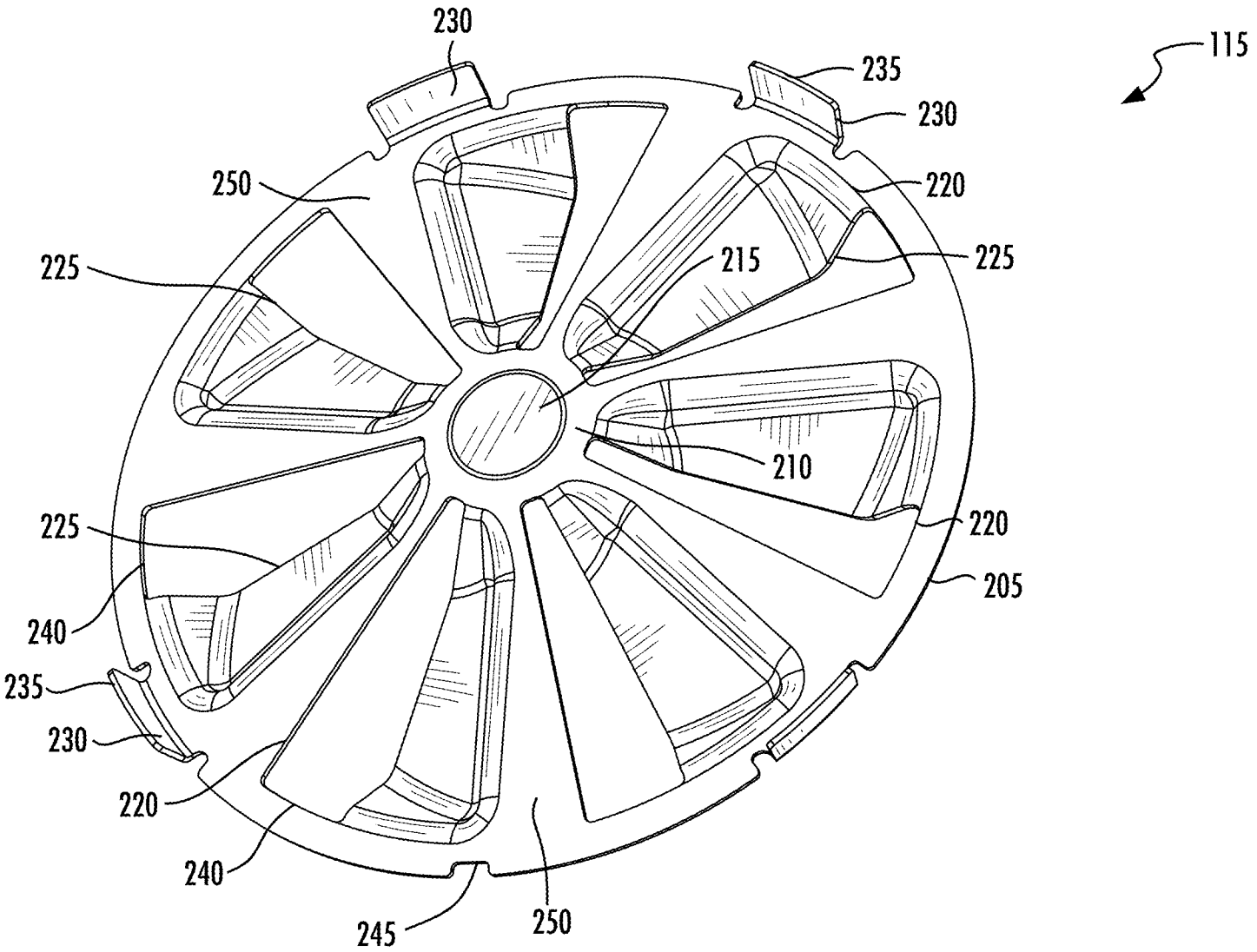
FIG. 2 illustrates a perspective view of a mixer for an aftertreatment system, according to an example implementation.

FIG. 2 illustrates a perspective view of the mixer 115 (e.g., mixing device) for the aftertreatment system 100. The mixer 115 can include an outer circumferential edge 205 defined by the outermost edge of a body of the mixer 115. The outer circumferential edge 205 of the mixer 115 can have a diameter equal to an exhaust conduit diameter. For example, the outer circumferential edge 205 of the mixer 115 can have a diameter equal to a diameter of the exhaust conduit 102. The outer circumferential edge 205 of the mixer 115 can have a diameter equal to an inner diameter of the exhaust conduit 102. There can be little to no gap between the outer circumferential edge 205 of the mixer 115 and an inner wall of the exhaust conduit 102. The outer circumferential edge 205 of the mixer 115 can have a diameter less than the diameter of the exhaust conduit 102. The outer circumferential edge 205 of the mixer 115 can have a diameter less than the inner diameter of the exhaust conduit 102. There can be a gap between the outer circumferential edge 205 of the mixer 115 and an inner wall of the exhaust conduit 102.

The mixer 115 can include a hub 210. The hub 210 can block exhaust gas from passing through the center of the mixer 115. The hub 210 can be positioned a distance from the DPF catalyst 117. For example, the hub 210 and the DPF catalyst 117 can be separated by a gap. In some embodiments, the hub 210 and the DPF catalyst 117 can be adjacent to each other. The hub 210 can include a flat portion 215. The flat portion 215 of the hub 210 can extend radially outward from a center of the hub 210. The flat portion 215 of the hub 210 can be radially symmetric. The hub 210 can have a curved portion that surrounds the flat portion 215 of the hub 210. The flat portion 215 of the hub 210 can be disposed in the center of the hub 210.

The mixer 115 can include a plurality of openings 220 (e.g., apertures, holes, perforations). Each of the plurality of openings 220 can extend in a region between the hub 210 and the outer circumferential edge 205 of the mixer 115. For example, each of the plurality of openings 220 can extend from the curved portion of the hub 210 towards the outer circumferential edge 205 of the mixer 115. The mixer 115 can include two or more openings. For example, the mixer 115 can include seven openings. By flowing exhaust gas through the plurality of openings 220, the exhaust gas can be caused to rotate downstream of the mixer 115. This rotation can facilitate mixing of particulate matter in the exhaust gas. The exhaust gas can pass or flow through the plurality of openings 220.

Each of the plurality of openings 220 can have an inner portion and an outer portion. The inner portion of each of the plurality of openings 220 can be disposed between the hub 210 and the outer portion of each of the plurality of openings 220. The outer portion of each of the plurality of openings 220 can be disposed between the inner portion of each of the plurality of openings 220 can the outer circumferential edge 205 of the mixer 115. The inner portion of each of the plurality of openings 220 can have a width less than a width of the outer portion of each of the plurality of openings 220. The outer portion of each of the plurality of openings 220 can have a width greater than a width of the inner portion of each of the plurality of openings 220. In some embodiments, the outer portion of each of the plurality of openings 220 can have a width equal to a width of the inner portion of each of the plurality of openings 220. Each of the plurality of openings 220 can be larger towards the outer circumferential edge 205 of the mixer 115 than towards the hub 210. Each of the plurality of openings 220 can be smaller towards the hub 210 than towards the outer circumferential edge 205 of the mixer 115. The plurality of openings 220 can radiate from the hub 210.

The outer circumferential edge 205, the flat portion 215 of the hub 210, and the plurality of openings 220 can define a frustoconical profile (e.g., shape). For example, the outer circumferential edge 205, the flat portion 215 of the hub 210, and the plurality of openings 220 can have the shape of a frustrum of a cone. The frustoconical profile can have sides partially defined by the plurality of openings 220. For example, the frustoconical profile can have sides partially defined by an edge of the plurality of openings 220. The frustoconical profile can have a first base defined by the outer circumferential edge 205 of the mixer 115. The frustoconical profile can have a second base defined by the flat portion 215 of the hub 210. For example, the frustoconical profile can have the second base defined by an edge of the flat portion 215 of the hub 210. The second base can be smaller than the first base. For example, the second base can have a diameter less than a diameter of the first base. The profile of the mixer 115 (e.g., frustoconical profile, conical profile) can have a lower backpressure penalty than a mixer with a flat profile. The profile of the mixer 115 can be angled.

The exhaust gas can be configured to contact the mixer 115 downstream of the outer circumferential edge 205 of the mixer 115. For example, the mixer 115 can be oriented in the aftertreatment system 100 such that the hub 210 is downstream of the outer circumferential edge 205 of the mixer 115. The mixer 115 can be oriented in the aftertreatment system 100 such that the outer circumferential edge 205 of the mixer 115 is upstream of the hub 210.

The exhaust gas can be configured to contact the mixer 115 upstream of the outer circumferential edge 205 of the mixer 115. For example, the mixer 115 can be oriented in the aftertreatment system 100 such that the hub 210 is upstream of the outer circumferential edge 205 of the mixer 115. The mixer 115 can be oriented in the aftertreatment system 100 such that the outer circumferential edge 205 of the mixer 115 is downstream of the hub 210.

The mixer 115 can include a plurality of fins 225 (e.g., louvers, louvres, blades, baffles, etc.). Each of the plurality of fins 225 can extend from at least one edge of the plurality of openings 220. For example, each of the plurality of fins 225 can extend from a portion of an edge of the plurality of openings 220. Each of the plurality of fins 225 can be convex relative to the hub 210. Each of the plurality of fins 225 can be concave relative to the hub 210. Each of the plurality of fins 225 can extend from the hub 210. Each of the plurality of fins 225 can extend from an inner portion of each of the plurality of openings 220 to an outer portion of each of the plurality of openings 220. Each of the plurality of fins 225 can have one or more inclined surfaces. The exhaust gas can pass or flow through a portion of the plurality of openings 220 that is not blocked by the plurality of fins 230. Each of the plurality of fins 225 can be configured to redirect the exhaust gas flowing through the exhaust conduit 102. Each of the plurality of fins 225 can be configured to assist in mixing the particulate matter within the exhaust conduit 102.

The mixer 115 can include a plurality of tabs 230 (e.g., weld tabs, press-in tabs, press-in weld tabs). The plurality of tabs 230 can be disposed along the outer circumferential edge 205 of the mixer 115. The plurality of tabs 230 can be distributed along an outer circumference of the mixer 115. Each of the plurality of tabs 230 can include a leading edge 235. The leading edge 235 of each of the plurality of tabs 230 can be separated from the outer circumferential edge 205 of the mixer 115. Each of the plurality of tabs 230 can elastically deform upon insertion into the exhaust conduit 102. For example, each of the plurality of tabs 230 can elastically deform upon insertion of the mixer 115 into the exhaust conduit 102. Each of the plurality of tabs 230 can bend toward the hub 210 upon insertion of the mixer 115 into the exhaust conduit 102.

The mixer 115 can include two or more tabs. For example, the mixer 115 can include four tabs. The plurality of tabs 230 can be spaced equidistantly around the outer circumferential edge 205 of the mixer 115. A distance between a first tab of the plurality of tabs 230 and a second tab of the plurality of tabs 230 can be the same as or different from a distance between the second tab of the plurality of tabs 230 and a third tab of the plurality of tabs 230. A distance between the third tab of the plurality of tabs 230 and a fourth tab of the plurality of tabs 230 can be the same as or different from the distance between the first tab of the plurality of tabs 230 and the second tab of the plurality of tabs 230. The distance between the fourth tab of the plurality of tabs 230 and the first tab of the plurality of tabs 230 can be the same as or different from the distance between the first tab of the plurality of tabs 230 and the second tab of the plurality of tabs 230.

The mixer 115 can include an inner circumferential edge 240. The inner circumferential edge 240 can be defined by the plurality of openings 220. For example, the inner circumferential edge 240 can be defined by an outermost edge of each of the plurality of openings 220. Each of the plurality of fins 225 can extend from the inner circumferential edge 240. For example, each of the plurality of fins 225 can extend from a portion of the inner circumferential edge 240.

The mixer 115 can include a plurality of spokes 250. Each of the plurality of spokes 250 can extend from the hub 210 to the outer circumferential edge 205 of the mixer 115. Each of the plurality of spokes 250 can be positioned between two openings of the plurality of openings 220. For example, each of the plurality of spokes 250 can be positioned between a first opening of the plurality of openings 220 and a second opening of the plurality of openings 220. The plurality of spokes 250 can separate the inner circumferential edge 240 into multiple portions. Each of the plurality of spokes 250 can be flat. The mixer 115 can include one or more spokes. For example, the mixer 115 can include seven spokes. The mixer 115 can include the same number of spokes as openings. The plurality of spokes 250 can radiate from the hub 210.

The outer circumferential edge 205, the flat portion 215 of the hub 210, and the plurality of spokes 250 can define a frustoconical profile (e.g., shape). For example, the outer circumferential edge 205, the flat portion 215 of the hub 210, and the plurality of spokes 250 can have the shape of a frustrum of a cone. The frustoconical profile can have sides defined by the plurality of spokes 250. For example, the frustoconical profile can have sides defined by a surface of the plurality of spokes 250. The frustoconical profile can have a first base defined by the outer circumferential edge 205 of the mixer 115. The frustoconical profile can have a second base defined by the flat portion 215 of the hub 210. For example, the frustoconical profile can have the second base defined by an edge of the flat portion 215 of the hub 210.

The mixer 115 can include a notch 245 (e.g., recess). The notch 245 can be disposed on the outer circumferential edge 205 of the mixer 115. The notch 245 can be configured to allow a liquid to flow from a first side of the mixer 115 to a second side of the mixer 115. For example, the notch 245 can allow the liquid to flow from upstream the mixer 115 to downstream the mixer 115. The notch 245 can allow the liquid to flow from downstream the mixer 115 to upstream the mixer 115.

Figure 3:
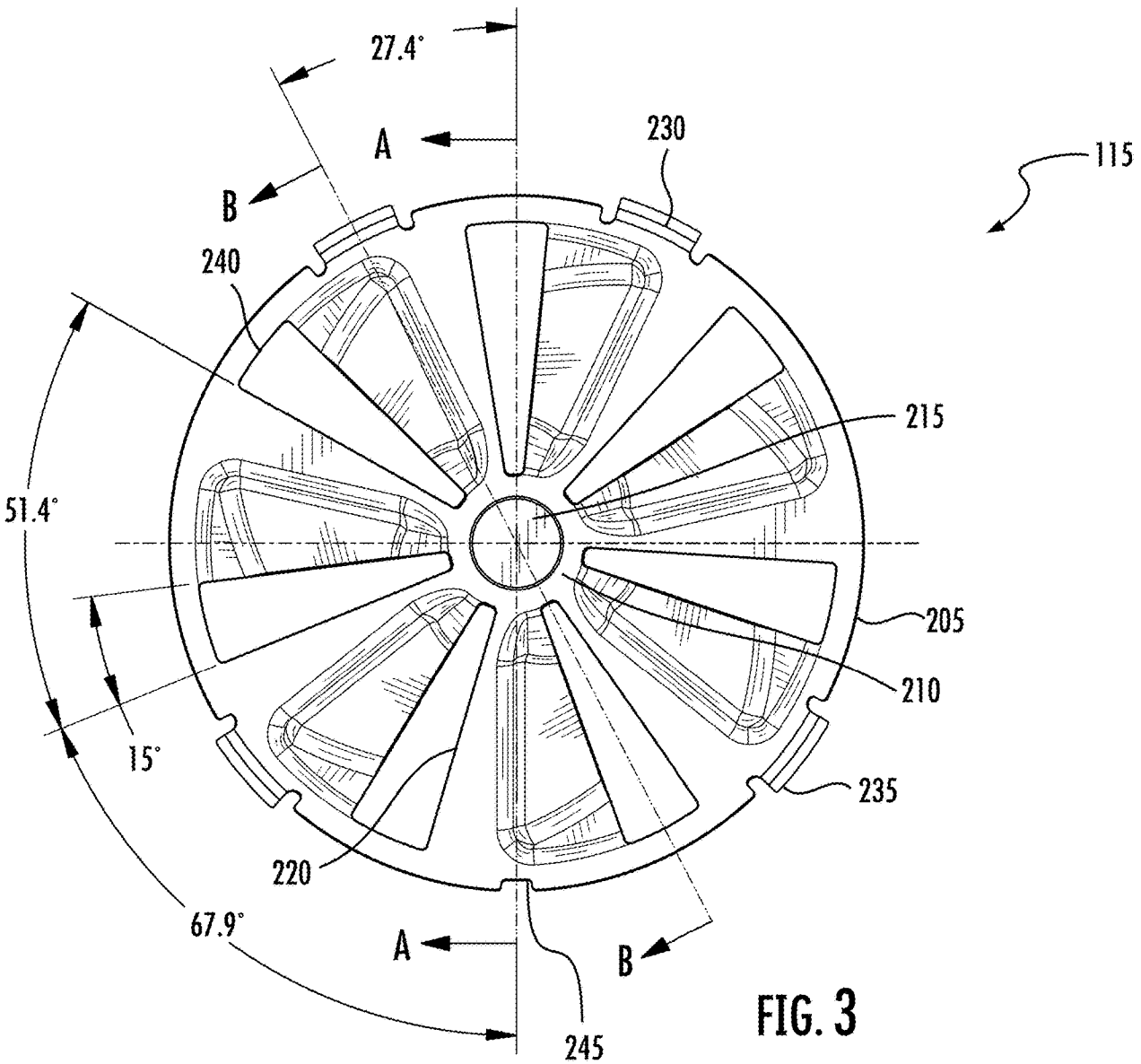
FIG. 3 illustrates a front view of a mixer for an aftertreatment system, according to an example implementation.

FIG. 3 illustrates a front view of mixer 115 for the aftertreatment system 100. The mixer 115 can include the outer circumferential edge 205, the hub 210, the plurality of openings 220, the plurality of fins 225, the plurality of tabs 230, the inner circumferential edge 240, the plurality of spokes 250, and the notch 245. The hub 210 can include the flat portion 215. The angles shown (e.g., 27.4°, 51.4°, and 67.9°) are examples and non-limiting.

Figure 4:
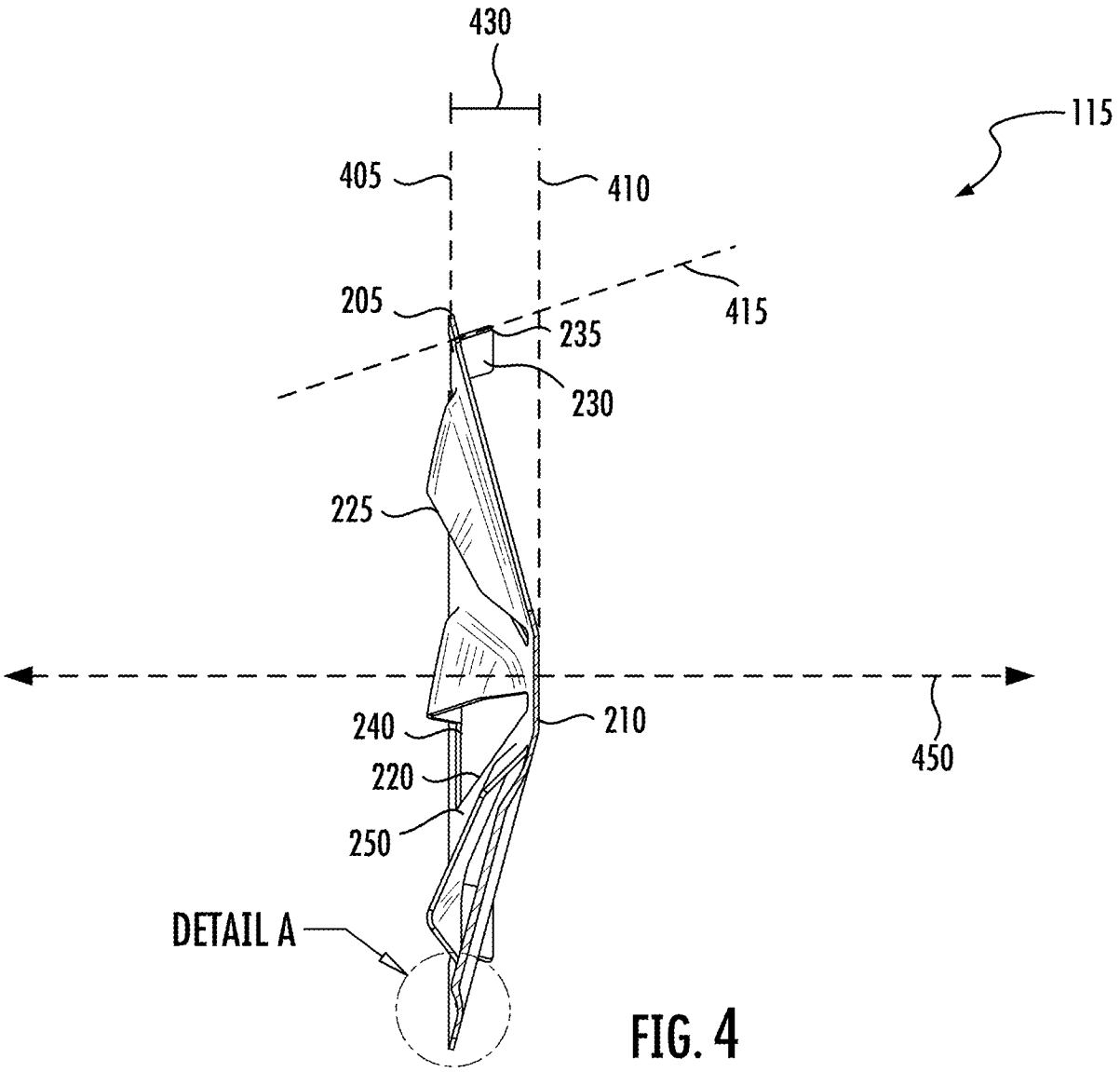
FIG. 4 illustrates a cross-sectional view of the mixer shown in FIG. 3 taken along plane A-A, according to an example implementation.

FIG. 4 illustrates a cross-sectional view of the mixer 115 shown in FIG. 3 taken along plane A-A. The mixer 115 can include the outer circumferential edge 205, the hub 210, the plurality of openings 220, the plurality of fins 225, the plurality of tabs 230, the inner circumferential edge 240, and the plurality of spokes 250.

The outer circumferential edge 205 can extend in a first plane 405. The first plane 405 can be perpendicular to a longitudinal axis 450 of the mixer 115. The mixer 115 can be centered on the longitudinal axis 450. For example, a center point of a cross-section of the mixer 115 can be disposed on the longitudinal axis 450. The hub 210 can be centered on the longitudinal axis 450. The outer circumferential edge 205 of the mixer 115 can define a circle that lies on the first plane 405. The first plane 405 can be perpendicular to a longitudinal axis of the exhaust conduit 102. The longitudinal axis 450 of the mixer 115 can be parallel to the longitudinal axis of the exhaust conduit 102.

The hub 210 can extend in a second plane 410. For example, the flat portion 215 of the hub 210 can extend in the second plane 410. The second plane 410 can be perpendicular to the longitudinal axis 450 of the mixer 115. The flat portion 215 of the hub 210 can lie on the second plane 410. The second plane 410 can be perpendicular to the longitudinal axis of the exhaust conduit 102. The second plane 410 can be offset from the first plane 405. For example, the second plane 410 can be offset from the first plane 405 in a direction along the longitudinal axis 450. The second plane 410 can be separated from the first plane 405 by an offset 430.

Each of the plurality of tabs 230 can extend in a respective third plane 415. The leading edge 235 of each of the plurality of tabs 230 can be oriented towards the hub 210. The leading edge 235 of each of the plurality of tabs 230 can be oriented away from the longitudinal axis 450 of the mixer 115. The longitudinal axis 450 can be oblique to the respective third plane 415. For example, the longitudinal axis 450 can intersect the respective third plane 415 at an angle between 15° and 25°. The second plane 410 can be oblique to the respective third plane 415. The first plane 405 can be oblique to the respective third plane 415.

Figure 5:
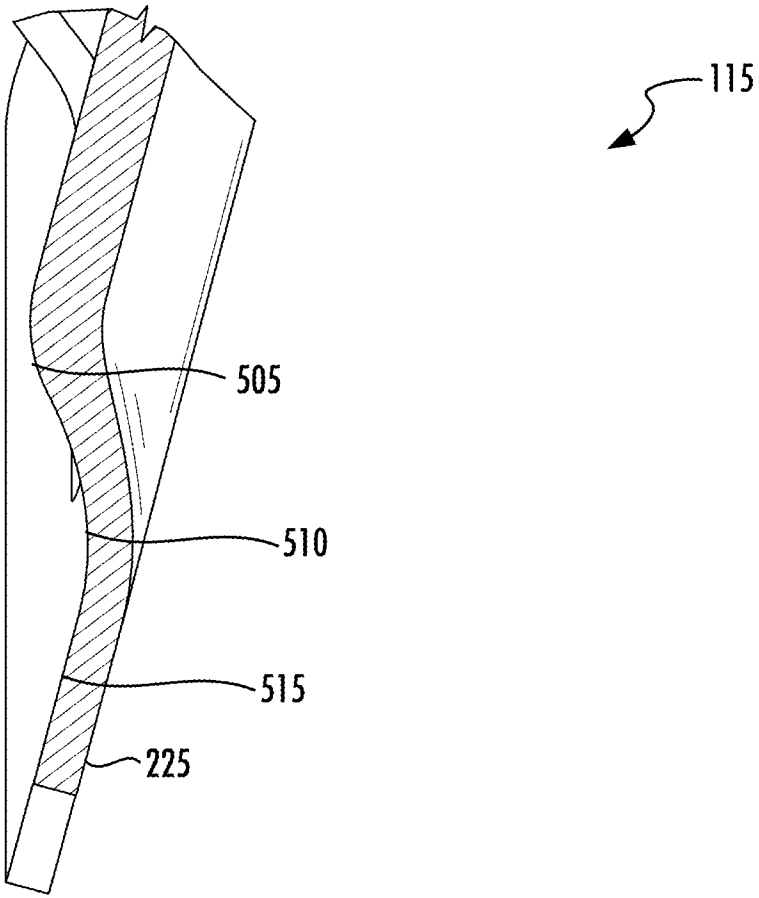
FIG. 5 illustrates a detailed view of DETAIL A in FIG. 4, according to an example implementation.

FIG. 5 illustrates a detailed view of DETAIL A in FIG. 4. The mixer 115 can include the plurality of fins 225. Each of the plurality of fins 225 can include multi-angle stamped louvers. For example, each of the plurality of fins 225 can include louvers with multiple angled surfaces. Each of the plurality of fins 225 can include a first portion 505. The first portion 505 can be curved. The first portion 505 can be convex relative to the hub 210. The first portion 505 can be concave relative to the hub 210. The first portion 505 can be convex relative to the outer circumferential edge 205 of the mixer 115. The first portion 505 can be concave relative to the outer circumferential edge 205 of the mixer 115. The first portion 505 can be coupled with the at least one edge of the plurality of openings 220. For example, the first portion 505 can connected to the at least one edge of the plurality of openings 220. The first portion 505 can be coupled with the inner circumferential edge 240. For example, the first portion 505 can be connected to the inner circumferential edge 240. The first portion 505 can be coupled with the hub 210. For example, the first portion 505 can be connected to the hub 210.

Each of the plurality of fins 225 can include a second portion 510. The second portion 510 can be curved. The second portion 510 can be concave relative to the hub 210. The second portion 510 can be convex relative to the hub 210. The second portion 510 can be convex relative to the outer circumferential edge 205 of the mixer 115. The second portion 510 can be concave relative to the outer circumferential edge 205 of the mixer 115. The second portion 510 can be coupled with the first portion 505. For example, the second portion 510 can be connected to the first portion 505. The second portion 510 and the first portion 505 can have opposite concavity. For example, the second portion 510 can be convex and the first portion 505 can be concave. The second portion 510 can be concave and the first portion 505 can be convex. The first portion 505 and the second portion 510 can form an incline. For example, the first portion 505 and the second portion 510 can form a gradual incline to reach a stamping depth. This can allow for increased formability of the mixer 115.

Each of the plurality of fins 225 can include a third portion 515. The third portion 515 can be flat. The third portion 515 can be coupled with the second portion 510. For example, the third portion 515 can be connected to the second portion 510. A surface area of the third portion 515 can be greater than a surface area of the second portion 510. The surface area of the third portion 515 can be greater than a surface area of the first portion 505. The exhaust gas can contact the first portion 505, the second portion 510, and/or the third portion 515. The exhaust gas can be redirected by the first portion 505, the second portion 510, and/or the third portion 515 through the plurality of openings 220. The exhaust gas can be redirected by the first portion 505, the second portion 510, and/or the third portion 515 from one side of the mixer 115 to the opposite side of the mixer 115.

Figure 6:
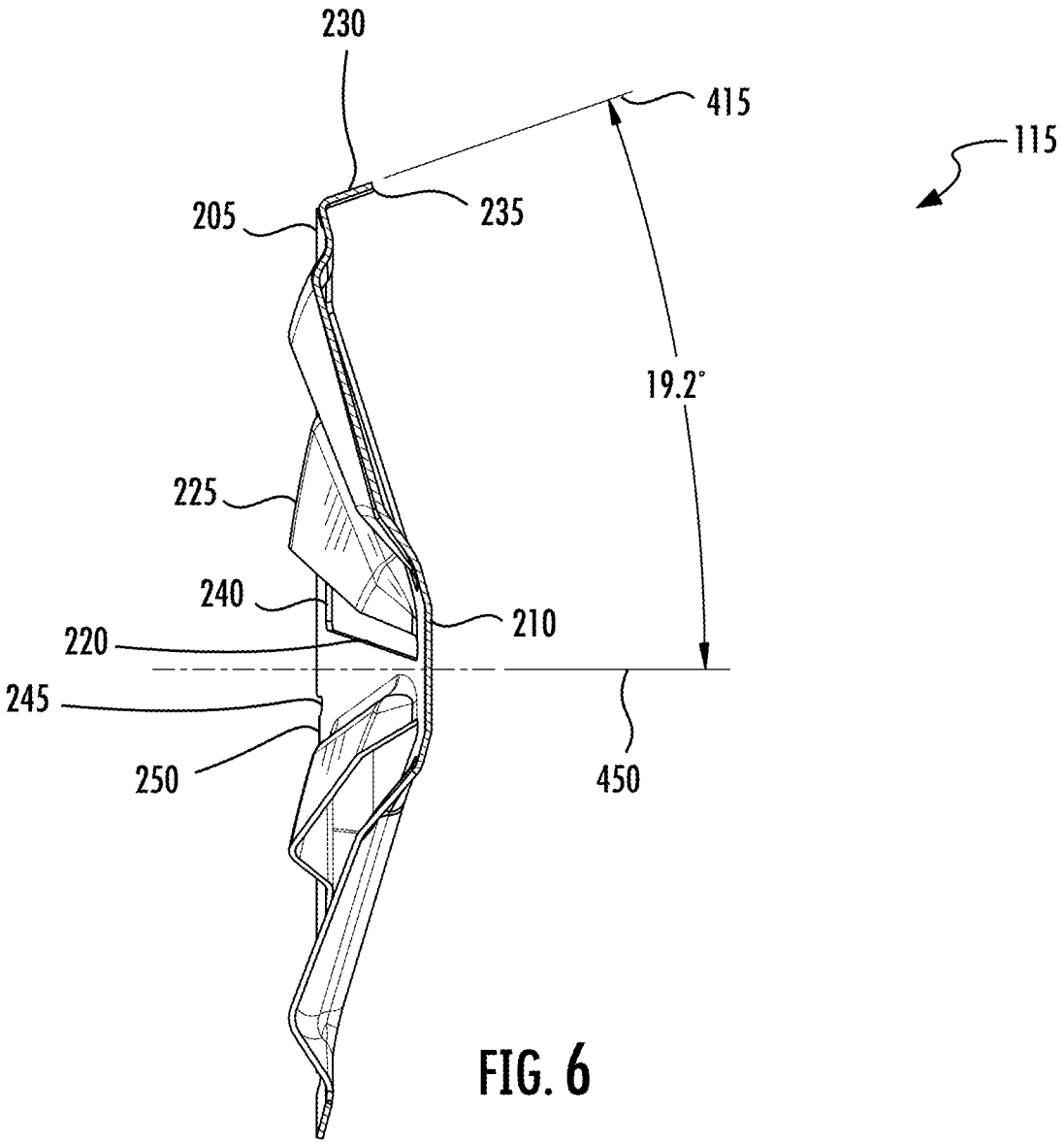
FIG. 6 illustrates a cross-sectional view of the mixer shown in FIG. 3 taken along plane B-B, according to an example implementation.

FIG. 6 illustrates a cross-sectional view of the mixer 115 shown in FIG. 3 taken along plane B-B. The mixer 115 can include the outer circumferential edge 205, the hub 210, the plurality of openings 220, the plurality of fins 225, the plurality of tabs 230, the inner circumferential edge 240, the notch 245, and the plurality of spokes 250. Each of the plurality of tabs 230 can include the leading edge 235. The angle shown (e.g., 19.2°) is an example and non-limiting.

Figure 7:
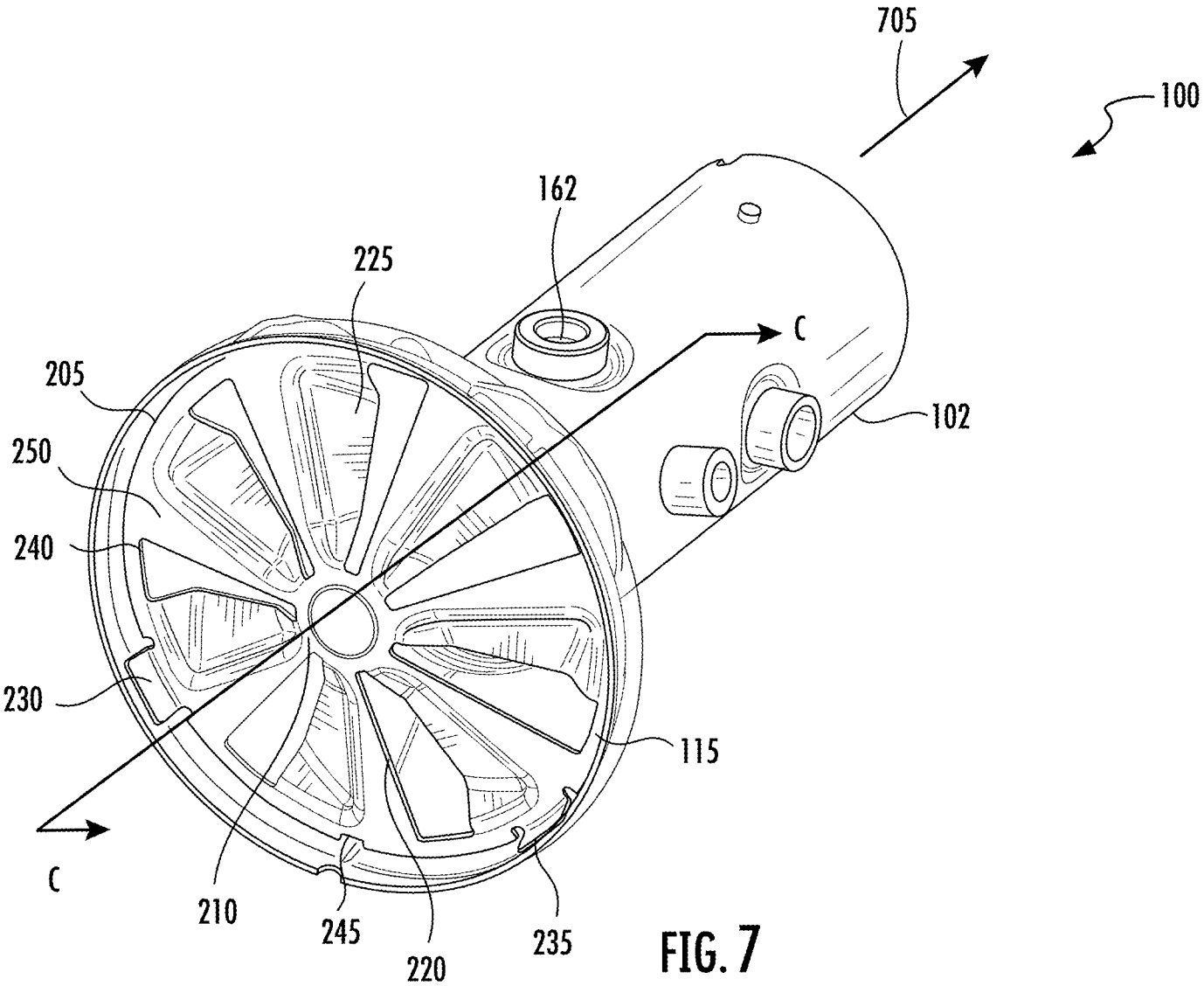
FIG. 7 illustrates a schematic diagram of a portion of an aftertreatment system with a mixer, according to an example implementation.

FIG. 7 illustrates a schematic diagram of a portion of the aftertreatment system 100 with the mixer 115. The aftertreatment system 100 can include the exhaust conduit 102, the mixer 115, and the sensor 162 (e.g., PM sensor). The mixer 115 can include the outer circumferential edge 205, the hub 210, the plurality of openings 220, the plurality of fins 225, the plurality of tabs 230, the inner circumferential edge 240, the notch 245, and the plurality of spokes 250. Each of the plurality of tabs 230 can include the leading edge 235.

The exhaust gas can flow in the exhaust conduit 102 in a direction 705. The mixer 115 can direct the flow of exhaust gas outwards from a center of the exhaust conduit 102. The mixer 115 can prevent or block the exhaust gas from flowing through the center of the mixer 115. The mixer 115 can direct the flow of exhaust gas through the exhaust conduit 102 to be in a single flow direction. For example, the mixer 115 can direct the flow of exhaust gas through the exhaust conduit 102 to be a clockwise direction. The mixer 115 can direct the flow of exhaust gas through the exhaust conduit 102 to be a counterclockwise direction.

The mixer 115 can include four tabs. The plurality of tabs 230 can be spaced equidistantly around the outer circumferential edge 205 of the mixer 115. The distance between the first tab of the plurality of tabs 230 and the second tab of the plurality of tabs 230 can be the same as or different from the distance between the second tab of the plurality of tabs 230 and the third tab of the plurality of tabs 230. The distance between the third tab of the plurality of tabs 230 and the fourth tab of the plurality of tabs 230 can be the same as or different from the distance between the first tab of the plurality of tabs 230 and the second tab of the plurality of tabs 230. The distance between the fourth tab of the plurality of tabs 230 and the first tab of the plurality of tabs 230 can be the same as or different from the distance between the first tab of the plurality of tabs 230 and the second tab of the plurality of tabs 230.

Figure 8:
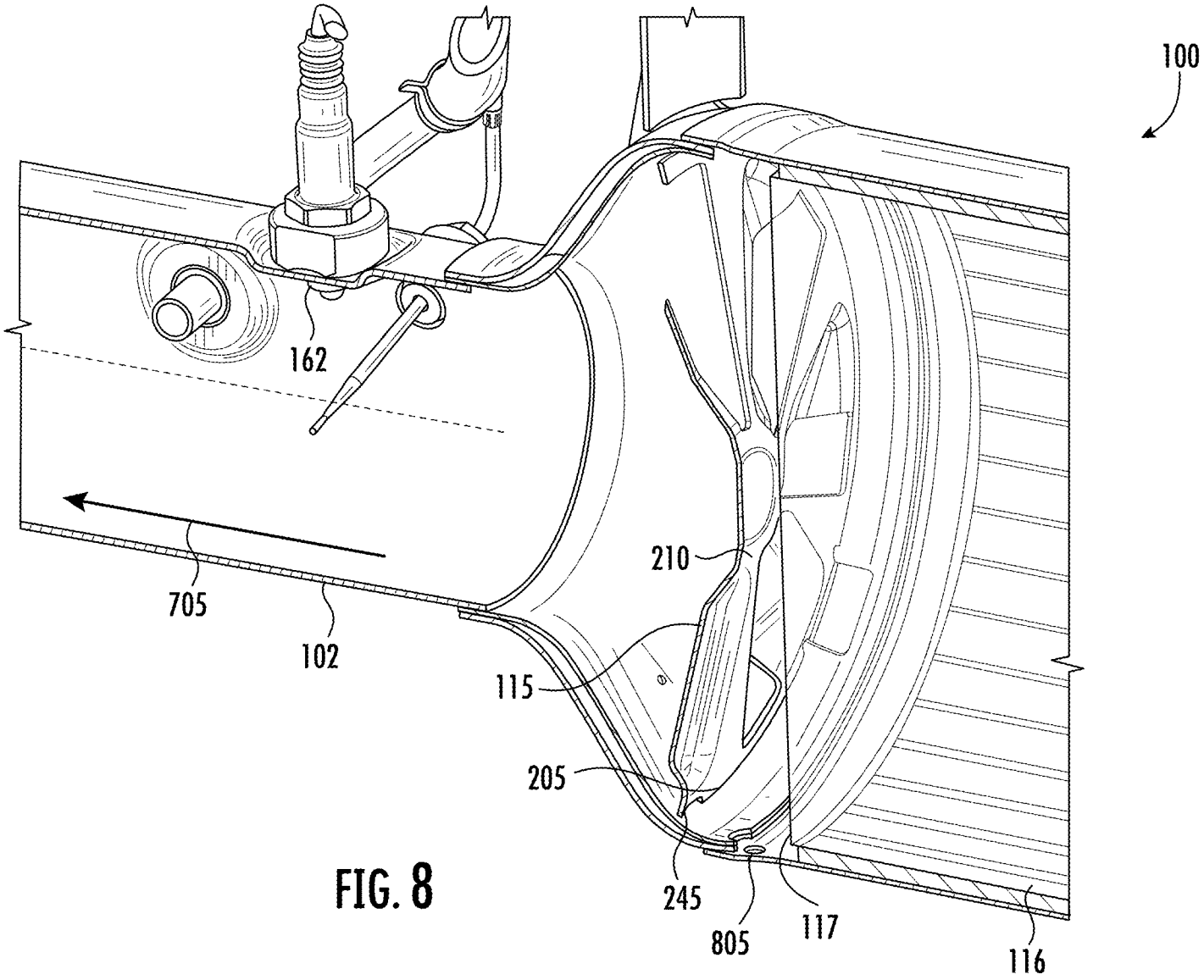
FIG. 8 illustrates a cross-sectional view of the portion of the aftertreatment system with the mixer shown in FIG. 7 taken along plane C-C, according to an example implementation.

FIG. 8 illustrates a cross-sectional view of the portion of the aftertreatment system 100 with the mixer 115 shown in FIG. 7 taken along plane C-C. The aftertreatment system 100 can include the exhaust conduit 102, the mixer 115, the sensor 162 (e.g., PM sensor), the particulate filter 116, and the DPF catalyst 117. The mixer 115 can include the outer circumferential edge 205, the hub 210, and the notch 245. Each of the plurality of tabs 230 can include the leading edge 235. The exhaust gas leaving the particulate filter 116 can be mixed by the mixer 115 before the exhaust gas reaches the sensor 162.

The notch 245 can be disposed on the outer circumferential edge 205 of the mixer 115. The notch 245 can be configured to engage with an alignment element. The alignment element can be disposed in the exhaust conduit 102. For example, the alignment element can be coupled to an inner wall of the exhaust conduit 102. The alignment element can orient the mixer 115 in a target orientation. The notch 245 can engage with the alignment element such that the mixer 115 is positioned in the exhaust conduit 102 according to the target orientation. The notch 245 can be used to index the rotation of the mixer 115.

The exhaust conduit 102 can have a hole 805 (e.g., drain hole). The notch 245 can allow a liquid to flow from the first side of the mixer 115 to the second side of the mixer 115. The second side of the mixer 115 can be upstream of the first side of the mixer 115. The hole 805 can be located upstream of the mixer 115. The liquid can flow from the first side of the mixer 115, to the second side of the mixer 115, and through the hole 805. The liquid can flow out of the exhaust conduit 102 via the hole 805. Without the hole 805, the liquid can pool in the exhaust conduit 102.

Figure 9:
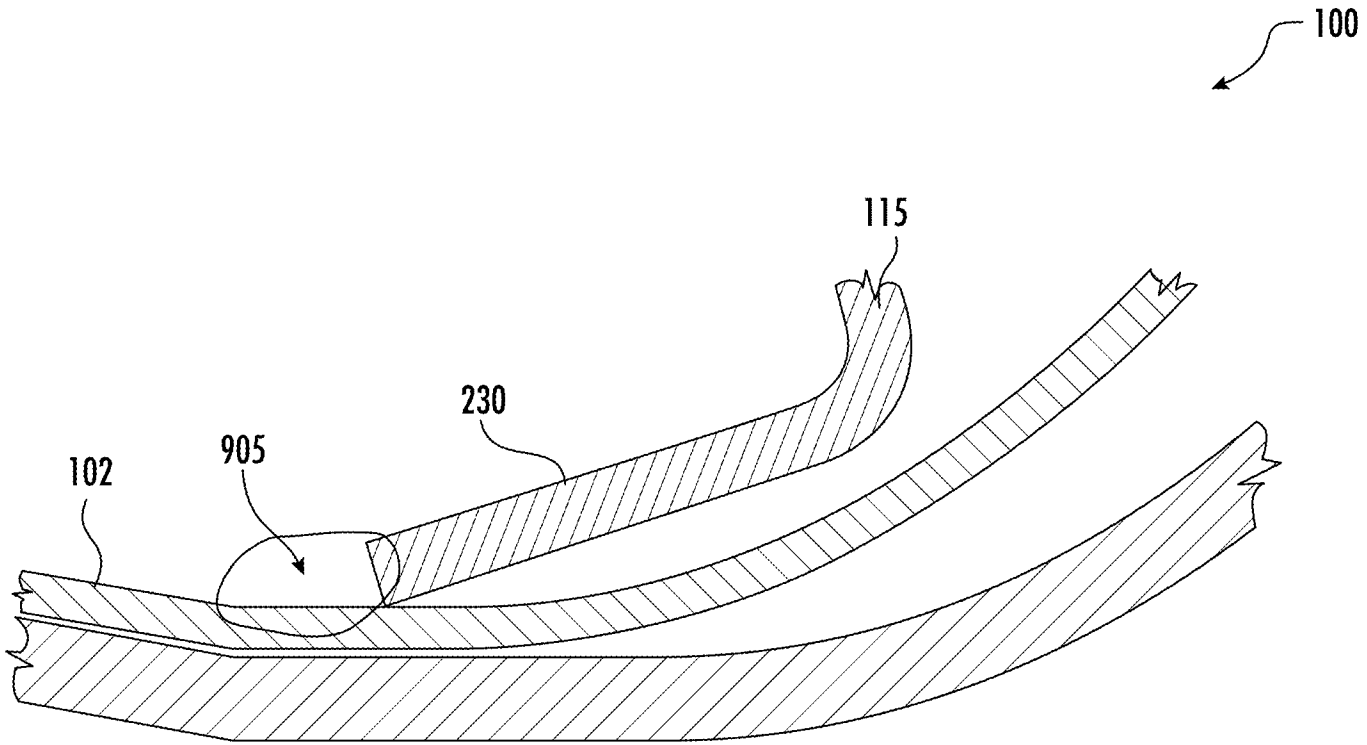
FIG. 9 illustrates a cross-sectional view of a portion of an aftertreatment system, according to an example implementation.

FIG. 9 illustrates a cross-sectional view of a portion of the aftertreatment system 100. The aftertreatment system 100 can include the mixer 115. The mixer 115 can include the plurality of tabs 230. The plurality of tabs 230 can be disposed along the outer circumferential edge 205 of the mixer 115. The plurality of tabs 230 can be welded to the exhaust conduit 102. For example, the plurality of tabs 230 can be welded to an inner wall of the exhaust conduit 102. Each of the plurality of tabs 230 can be coupled with the inner wall of the exhaust conduit 102 via a weld 905 (e.g., weld joint). Elastic deformation of the plurality of tabs 230 can reduce a gap (e.g., weld gap) between each of the plurality of tabs 230 and the exhaust conduit 102. The exhaust conduit 102 can encompass the plurality of tabs 230. The exhaust conduit 102 can encompass the mixer 115.

Figure 10:
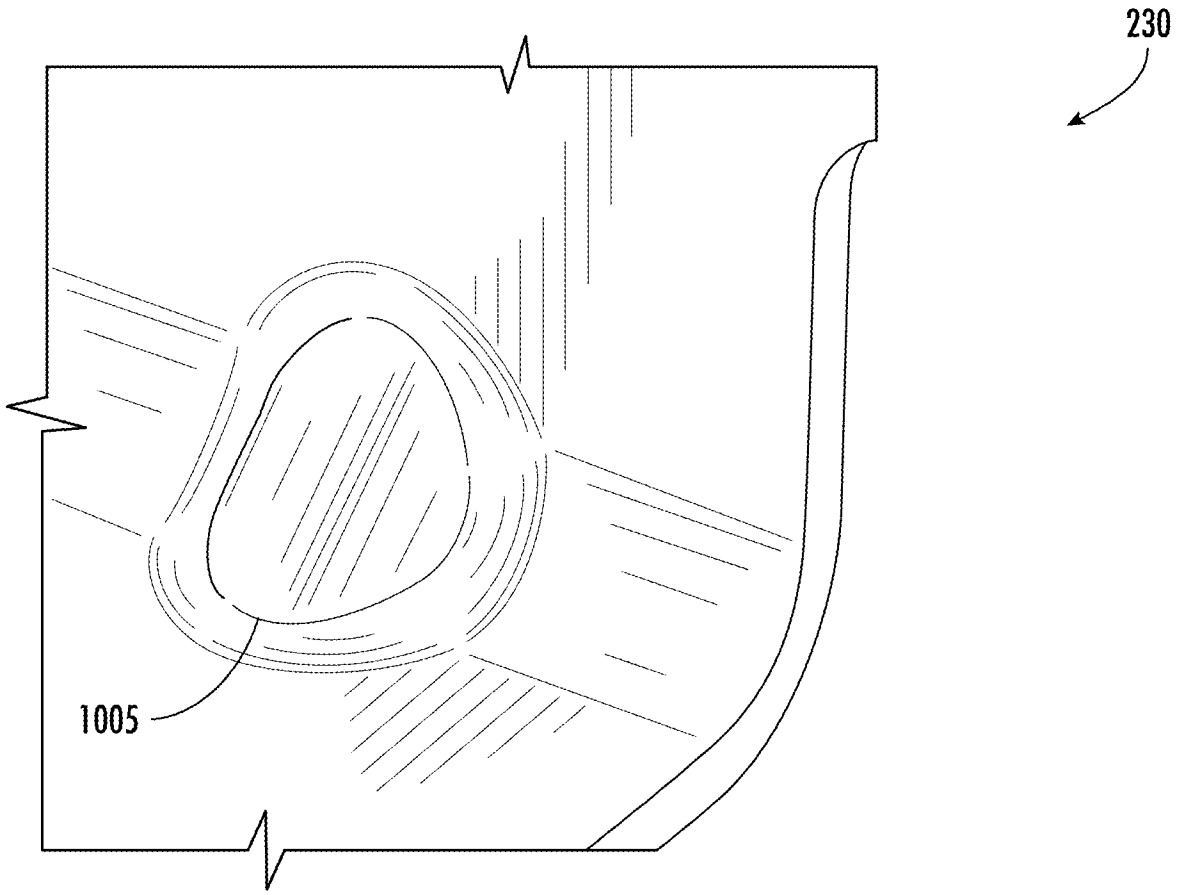
FIG. 10 illustrates a portion of a tab, according to an example implementation.

FIG. 10 illustrates a portion of a tab of the plurality of tabs 230. The tab can be tunable. For example, the properties of the tab can be tuned. The properties of the tab can include, for example, stiffness of the tab or spring-back of the tab. A rib 1005 can be stamped into the tab to stiffen the tab. A stiffer tab can have less spring-back, while a less stiff tab can have more spring-back. The spring-back of the tab can be controlled by embossing the tab or changing the width of the tab.

Figure 11:
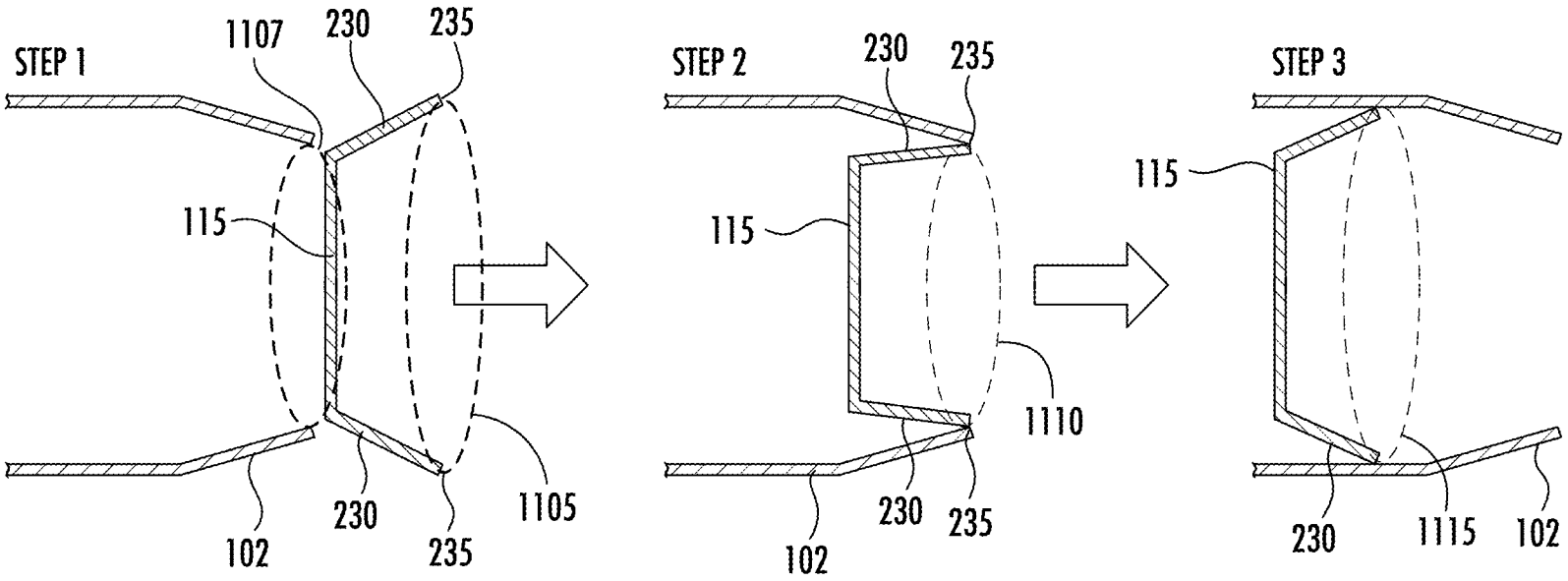
FIG. 11 illustrates a schematic diagram of inserting a mixer into an exhaust conduit, according to an example implementation.

FIG. 11 illustrates a schematic diagram of inserting the mixer 115 into the exhaust conduit 102. The mixer 115 can include the plurality of tabs 230. The plurality of tabs 230 can be disposed along the outer circumferential edge 205 of the mixer 115. Each tab of the plurality of tabs 230 can include the leading edge 235.

As shown in Step 1, prior to the mixer 115 being positioned in the exhaust conduit 102, the plurality of leading edges 235 can be arranged around a first circle 1105. The first circle 1105 can have a first diameter greater than an exhaust conduit diameter (e.g., conduit diameter). The exhaust conduit diameter can be defined by the diameter of a conduit circle 1107. The exhaust conduit diameter can be defined by the inner diameter of the exhaust conduit 102. The mixer 115 can be inserted into the exhaust conduit 102. During the process of inserting the mixer 115 into the conduit, the plurality of tabs 230 can flex or bend towards the center of the mixer 115. For example, the plurality of tabs 230 can elastically deform upon insertion of the mixer 115 into the exhaust conduit 102. The plurality of tabs 230 can bend inwards upon insertion of the mixer 115 into the exhaust conduit 102. The plurality of tabs 230 can bend towards the hub 210 upon insertion of the mixer 115 into the exhaust conduit 102. The plurality of leading edges 235 can have larger interfacing envelope than that of the exhaust conduit 102.

As shown in Step 2, after the mixer 115 is positioned in the exhaust conduit 102, the plurality of leading edges 235 can be arranged around a second circle 1110. The second circle 1110 can have a second diameter equal to the exhaust conduit diameter. In some embodiments, the second diameter is less than the exhaust conduit diameter. The plurality of tabs 230 can press against the wall (e.g., inner wall) of the exhaust conduit 102. For example, the plurality of tabs 230 can apply a force to the inner wall of the exhaust conduit 102.

In some embodiments, as shown in Step 3, the plurality of tabs 230 can flex or bend towards the wall of the exhaust conduit 102. For example, the plurality of tabs 230 can elastically deform upon insertion of the mixer 115 into the exhaust conduit 102. The plurality of tabs 230 can bend outwards upon insertion of the mixer 115 into the exhaust conduit 102. The plurality of leading edges 235 can be arranged around a third circle 1115. The exhaust conduit 102 can have one or more diameters. For example, the exhaust conduit 102 can have a first exhaust conduit diameter and a second exhaust conduit diameter. The second exhaust conduit diameter can be greater than the first exhaust conduit diameter. The diameter of the first circle 1105 can be greater than the first exhaust conduit diameter. The third circle 1115 can have a diameter equal to or greater than the second exhaust conduit diameter.

Figure 12:
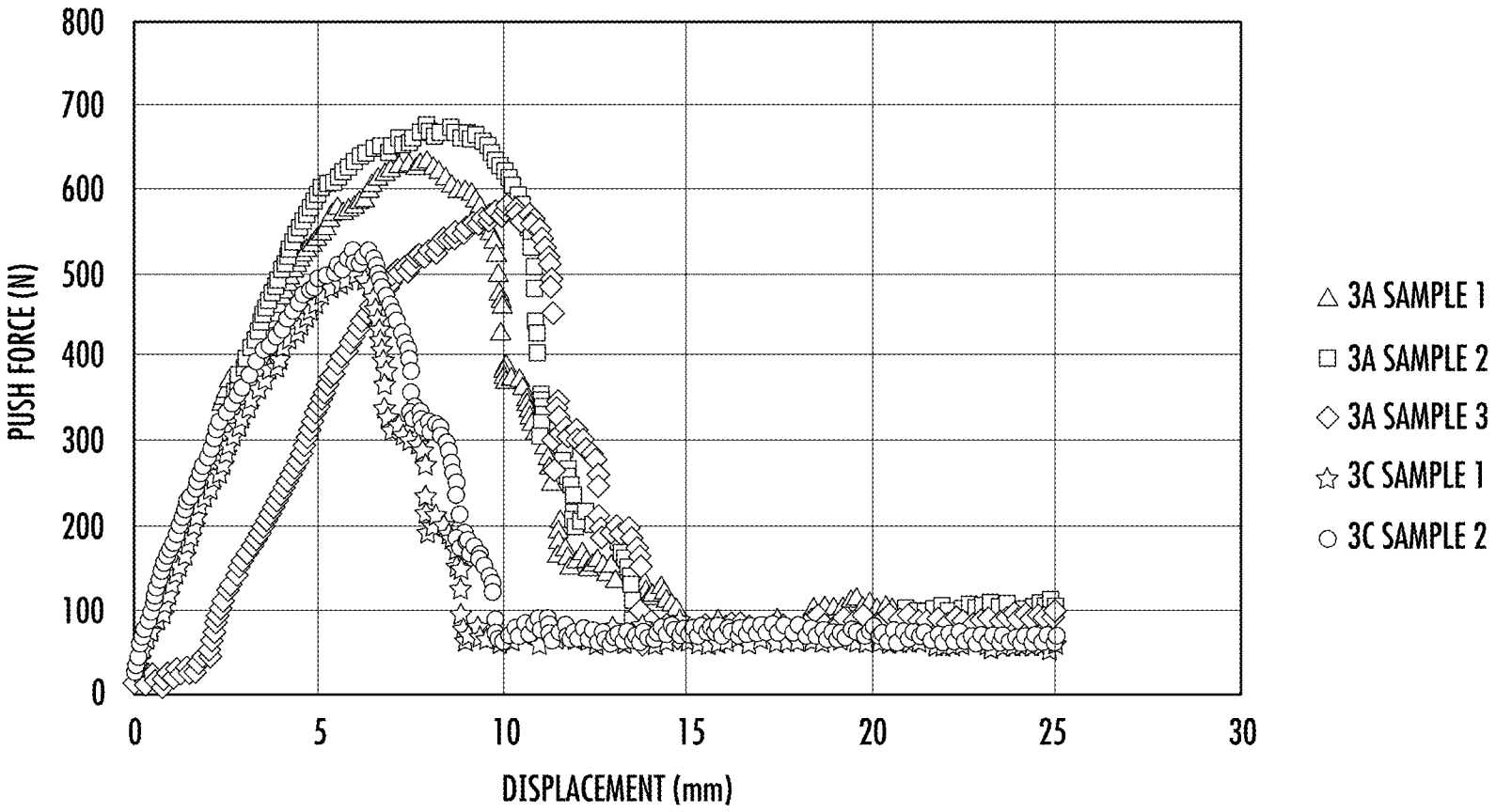
FIG. 12 illustrates a graph of push force vs. displacement, according to an example implementation.

FIG. 12 illustrates a graph of push force (N) vs. displacement (mm) of various mixer samples. The displacement can include the displacement of the mixer 115. The graph illustrates the amount of force needed to displace the various mixer samples within the exhaust conduit 102. The peak push-in force can be in a range of 505 N to 676 N. The non-zero force (e.g., constant push-in force) applied to the various mixer samples after the mixer has been displaced more than 5 mm indicates a non-zero force applied by the plurality of tabs 230. The constant push-in force can be in a range of 80 N to 100 N.

IV. Configuration of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the appended claims.

As used herein, the term "about," or similar terms, generally mean plus or minus 10% of the stated value. For example, about 0.5 would include 0.45 and 0.55, about 10 would include 9 to 11, about 1000 would include 900 to 1100.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

The terms "fluidly coupled to" and the like, as used herein, mean the two components or objects have a pathway formed between the two components or objects in which a fluid, such as air, treatment fluid, an air-treatment fluid mixture, exhaust, hydrocarbon fluid, an air-hydrocarbon fluid mixture, may flow, either with or without intervening components or objects. Examples of fluid couplings or configurations for enabling fluid communication may include piping, channels, or any other suitable components for enabling the flow of a fluid from one component or object to another.

Any implementation disclosed herein may be combined with any other implementation or embodiment, and references to "an implementation," "some implementations," "one implementation" or the like are not necessarily mutually exclusive and are intended to indicate that a particular feature, structure, or characteristic described in connection with the implementation may be included in at least one implementation or embodiment. Such terms as used herein are not necessarily all referring to the same implementation. Any implementation may be combined with any other implementation, inclusively or exclusively, in any manner consistent with the aspects and implementations disclosed herein.

Any references to implementations or elements or acts of the systems and methods herein referred to in the singular may also embrace implementations including a plurality of these elements, and any references in plural to any implementation or element or act herein may also embrace implementations including only a single element. References in the singular or plural form are not intended to limit the presently disclosed systems or methods, their components, acts, or elements to single or plural configurations. References to any act or element being based on any information, act or element may include implementations where the act or element is based at least in part on any information, act, or element.

It is important to note that the construction and arrangement of the various systems shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the disclosure, the scope being defined by the claims that follow. When the language "a portion" is used, the item can include a portion and/or the entire item unless specifically stated to the contrary.

Also, the term "or" is used, in the context of a list of elements, in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W1 to W2, etc.) herein are inclusive of their maximum values and minimum values (e.g., W1 to W2 includes W1 and includes W2, etc.), unless otherwise indicated. Furthermore, a range of values (e.g., W1 to W2, etc.) does not necessarily require the inclusion of intermediate values within the range of values (e.g., W1 to W2 can include only W1 and W2, etc.), unless otherwise indicated.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements; values of parameters, mounting arrangements; use of materials, colors, orientations, etc.) without materially departing from the novel teachings and advantages of the subject matter described herein. Additionally, it should be understood that features from one embodiment disclosed herein may be combined with features of other embodiments disclosed herein as one of ordinary skill in the art would understand. Other substitutions, modifications, changes, and omissions may also be made in the design, operating conditions, and arrangement of the various exemplary embodiments without departing from the scope of the present embodiments.

While this specification contains many specific implementation details, these should not be construed as limitations on the scope of any embodiments or of what may be claimed, but rather as descriptions of features specific to particular implementations of particular embodiments. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A mixer for an exhaust gas aftertreatment system, the mixer comprising:

an outer circumferential edge that extends in a first plane perpendicular to a longitudinal axis of the mixer;

a hub comprising a flat portion that extends in a second plane perpendicular to the longitudinal axis, the second plane being offset from the first plane in a direction along the longitudinal axis;

a plurality of openings, each extending in a region between the hub and the outer circumferential edge of the mixer; and a plurality of fins, each extending from at least one edge of the plurality of openings; wherein:

each opening of the plurality of openings comprises an inner circumferential edge and a radial edge, each fin of the plurality of fins is attached at least to an outermost edge of each opening and the radial edge of each opening, a radial edge of each fin on a side of the fin opposite the radial edge of each opening comprises, from the hub towards the outer circumferential edge of the mixer, a first portion, a second portion, and a third portion, an angle between the second portion of the radial edge of each fin and the first portion of the radial edge of each fin is greater than an angle between the second portion of the radial edge of each fin the third portion of the radial edge of each fin.

2. The mixer of claim 1, comprising:

a plurality of tabs disposed along the outer circumferential edge of the mixer; wherein:

each of the plurality of tabs extends in a respective third plane, a leading edge of each of the plurality of tabs is oriented towards the hub and away from the longitudinal axis of the mixer, and the longitudinal axis is oblique to the respective third plane.

3. The mixer of claim 1, wherein each of the plurality of fins is convex relative to the hub.

4. The mixer of claim 1, wherein each of the plurality of fins extends from the hub.

5. The mixer of claim 1, wherein the outer circumferential edge, the flat portion, and the plurality of openings define a frustoconical profile.

6. The mixer of claim 1, comprising:

a notch disposed on the outer circumferential edge of the mixer, the notch configured to allow a liquid to flow from a first side of the mixer to a second side of the mixer.

7. The mixer of claim 1, wherein:

each fin comprises:

a convex portion that is convex relative to the hub, the convex portion coupled with the at least one edge of the plurality of openings, and a concave portion that is concave relative to the hub, the concave portion coupled with the first portion.

8. The mixer of claim 1, comprising:

a plurality of spokes, each extending from the hub to the outer circumferential edge of the mixer and each positioned between two openings of the plurality of openings.

9. An aftertreatment system, comprising:

an exhaust conduit;

a filter disposed in the exhaust conduit;

a mixer disposed in the exhaust conduit at a location downstream of the filter, the mixer comprising:

an outer circumferential edge that extends in a first plane perpendicular to a longitudinal axis of the mixer;

a hub comprising a flat portion that extends in a second plane perpendicular to the longitudinal axis, the second plane being offset from the first plane in a direction along the longitudinal axis;

a plurality of openings, each extending in a region between the hub and the outer circumferential edge of the mixer; and a plurality of fins, each extending from at least one edge of the plurality of openings; wherein:

each opening of the plurality of openings comprises an inner circumferential edge and a radial edge, each fin of the plurality of fins is attached at least to an outermost edge of each opening the inner circumferential edge and the radial edge of each opening, and the plurality of fins are entirely upstream of the second plane; and a sensor disposed in the exhaust conduit at a location downstream of the mixer.

10. The aftertreatment system of claim 9, wherein the mixer comprises a notch disposed on the outer circumferential edge of the mixer, the notch configured to engage with an alignment element disposed in the exhaust conduit.

11. The aftertreatment system of claim 9, wherein exhaust gas is configured to contact the mixer downstream of the outer circumferential edge of the mixer.

12. The aftertreatment system of claim 9, wherein exhaust gas is configured to contact the mixer upstream of the outer circumferential edge of the mixer.

13. The aftertreatment system of claim 9, wherein the mixer comprises a plurality of tabs disposed along the outer circumferential edge of the mixer, the plurality of tabs configured to be welded to the exhaust conduit.

14. The aftertreatment system of claim 9, wherein:

the mixer comprises a plurality of tabs disposed along the outer circumferential edge of the mixer, each tab of the plurality of tabs comprise a leading edge, prior to the mixer being positioned in the exhaust conduit, the plurality of leading edges are arranged around a first circle having a first diameter greater than an exhaust conduit diameter, and after the mixer is positioned in the exhaust conduit, the plurality of leading edges are arranged around a second circle having a second diameter equal to the exhaust conduit diameter.

15. The aftertreatment system of claim 9, comprising:

a diesel particulate filter catalyst disposed in the exhaust conduit at a location downstream of the filter and upstream of the mixer;

wherein the hub is positioned a distance from the diesel particulate filter catalyst.

16. The aftertreatment system of claim 9, wherein:

the mixer comprises a plurality of tabs disposed along the outer circumferential edge of the mixer, and the plurality of tabs configured to elastically deform upon insertion into the exhaust conduit.

17. The aftertreatment system of claim 9, wherein the outer circumferential edge of the mixer has a diameter equal to an exhaust conduit diameter.

18. An aftertreatment system, comprising:

an exhaust conduit;

a filter disposed in the exhaust conduit;

a mixer disposed in the exhaust conduit at a location downstream of the filter; and a sensor disposed in the exhaust conduit at a location downstream of the mixer; wherein:

the mixer comprises:

an outer circumferential edge and a hub;

a plurality of spokes each comprising a flat portion and extending from the hub to the outer circumferential edge; and a plurality of tabs disposed along the outer circumferential edge of the mixer and each extending from at least one flat portion, each tab of the plurality of tabs comprise a leading edge configured to contact the exhaust conduit, prior to the mixer being positioned in the exhaust conduit, the plurality of leading edges are arranged around a first circle having a first diameter greater than an exhaust conduit diameter, and after the mixer is positioned in the exhaust conduit, the plurality of leading edges are arranged around a second circle having a second diameter equal to the exhaust conduit diameter; wherein:

the outer circumferential edge extends in a first plane perpendicular to a longitudinal axis of the mixer, the hub extends in a second plane perpendicular to the longitudinal axis of the mixer;

each of the plurality of tabs and the respective leading edge extend in a respective third plane, the leading edge of each of the plurality of tabs is oriented towards the hub and away from the longitudinal axis of the mixer, and the longitudinal axis is oblique to the respective third plane.

19. The aftertreatment system of claim 18, wherein the second plane is offset from the first plane in a direction along the longitudinal axis.

20. The aftertreatment system of claim 18, the plurality of tabs are configured to be welded to the exhaust conduit.

21. The aftertreatment system of claim 18, wherein the plurality of tabs are configured to elastically deform upon insertion into the exhaust conduit.

22. The aftertreatment system of claim 18, wherein the mixer comprises a notch disposed on the outer circumferential edge of the mixer, the notch configured to allow a liquid to flow from a first side of the mixer to a second side of the mixer.

23. The aftertreatment system of claim 18, wherein the mixer comprises a notch disposed on the outer circumferential edge of the mixer, the notch configured to engage with an alignment element disposed in the exhaust conduit.

* * * * *